United States Patent [19]

Giesick

[11] Patent Number: 4,856,110

[45] Date of Patent: Aug. 15, 1989

[54] ATHLETIC PROTECTIVE SAFETY SOCK

[76] Inventor: Gary Giesick, 18502 Mateney Rd., Germantown, Md. 20874

[21] Appl. No.: 211,293

[22] Filed: Jun. 24, 1988

[51] Int. Cl.[4] ..... A41D 13/06; A41B 11/00

[52] U.S. Cl. ..... 2/22; 2/239; 66/202

[58] Field of Search ..... 2/22, 2.5, 2, 167, 239; 66/202; 36/DIG. 2

[56] References Cited

U.S. PATENT DOCUMENTS

| | | |
|---|---|---|
| Re. 32,506 | 9/1987 | Hightower, Jr. . |
| 2,129,226 | 9/1938 | Montano . |
| 3,902,196 | 9/1975 | Reinfandt . |
| 4,004,295 | 1/1977 | Byrnes, Sr. . |
| 4,280,342 | 7/1981 | Eng et al. . |
| 4,356,569 | 11/1982 | Sullivan . |
| 4,608,716 | 9/1986 | Brumfield . |
| 4,669,126 | 6/1987 | Jones . |

FOREIGN PATENT DOCUMENTS

| | | |
|---|---|---|
| 0202183 | 11/1986 | European Pat. Off. . |
| 2039685 | 5/1971 | Fed. Rep. of Germany . |
| 2572260 | 5/1986 | France ..... 3/DIG. 2 |
| 136689 | 9/1960 | U.S.S.R. . |

OTHER PUBLICATIONS

"Kevlar Aramid", Modern Textiles, Nov. 1976, pp. 26–30.

Catalog of Hockey Equipment; Shin Pads advertisement, p. 15 (date unknown).

*Primary Examiner*—H. Hampton Hunter

*Attorney, Agent, or Firm*—Barnes & Thornburg

[57] ABSTRACT

An improved athletic sock for preventing lacerations and/or punctures to the legs, particularly of ice hockey players and other athletes. The sock is constructed from woven material which includes aramid and metallic fibers woven into the entire sock or into an insert portion thereof, which covers the unprotected back of the athlete's leg, thus protecting the gastrocnemius muscle and achilles tendon of the wearer.

3 Claims, 1 Drawing Sheet

ATHLETIC PROTECTIVE SAFETY SOCK

BACKGROUND AND SUMMARY OF THE INVENTION

The present invention relates to a protective safety sock that covers the leg and underlying equipment, such as a shin guard and/or pad, and the straps to hold the same in place, of an ice hockey player or other athlete, for providing armored protection against cuts to the back of an athlete's leg.

Current athletic socks used by hockey players cover underlying equipment, are lightweight and are woven from colors of yarn that complement the uniform design of the athlete's team. They may also provide a small degree of protection to the athlete's skin from abrasions caused by ice, grass, dirt, and synthetic surfaces such as "astro turf" and like materials. In high speed, body contact sports, or activities in which sporting equipment such as ice or figure skates, ice hockey sticks, field hockey sticks, lacrosse sticks, goal cages, side field markers and chains, skis, are used, more protection is needed. This is especially true for ice hockey players where serious cuts are well documented as part and parcel of these activities.

Currently, hockey players wear shin guards and pads. The shin guard covers the front of the lower leg and the knee and is constructed of a ¼" thick volara cloth pad covered with white nylon and covered with a foam cushion. A large knee cap pad is pivotally attached to the shin guard and both are constructed of high impact reinforced polyethylene backed by a thick pad of foam. The shin guard is strapped to the hockey player's leg. The shin pad provides excellent impact and cut protection in the polyethylene covered areas, but leaves the back of the leg unprotected. The sock is normally manufactured in team colors and is light in weight and flexible to allow quick forward, backward and lateral skating movements, but does not provide cut protection to the back calf and thigh sections of the leg in the areas not covered by reinforced polyethelene.

Ice hockey skates are sharpened regularly, sometimes daily or after each game or practice, using a special grinding machine that will grind the part of the blade that comes in contact with the ice into a concave shape providing an outer and inner sharp edge. After grinding, these edges are further filed with a stone placed flat against the inside and outside of the blade to remove any splinters remaining from the grinding process. The edges are extremely sharp and provide the skater with the necessary ice biting edge for skating acceleration, turning, and quick stops.

Ice hockey goal tenders do not wear the conventional shin pads as described earlier. In place of the shin pad, goal tenders wear large pads on the front of the legs the size of which depends on the size of the goal tender and are secured by straps and buckles encircling the leg. The area of the back of the leg between the straps is covered and protected only by a woven sock and is vulnerable to cuts in the course of regular play.

The invention herein provides a protective athletic sock that provides cut protection in addition to the conventional functions of athletic socks. This is accomplished by fabricating the entire sock, or that portion of the sock that covers the unprotected area of the leg, from a woven metallic and aramid synthetic yarn. The aramid portions of this yarn may be made by using fibers such as Nomex or Nomex III. Nomex has a tensile strength which is almost that of nylon and has a very high abrasive strength and resistance to cutting. The metallic strands form a barrier to the sharp skate blades. Nomex and Nomex III are registered trademarks for aramid fibers of E. I. du Pont de Nemours & Co. Nomex contains 65% nylon and 35% polyester with a silicon addition which chemically blends with and becomes part of the fiber. The tensile strength is almost that of nylon with very high resistance to cutting and abrasion. Nomex III is 5% Kevlar (also a registered trademark of E. I. du Pont de Nemours & Co.) and 95% Nomex. Kevlar is a high strength, lightweight aramid fiber which will not shrink and can be washed in hot water and detergent. Also, it can be dried in a hot air dryer. Nomex or Nomex III fibers combined with a metallic strand are used to form the yarn to be woven or knitted into the protective sock.

In selecting the particular weave, care must be taken to assure a light weight protective fabric sock that will not be cumbersome or decrease mobility. If either of these factors is present, hockey players will probably not wear the safety sock. The aramid-metallic yarn used in the protective safety sock can also be color coordinated to the team uniform.

An advantage accrues by making only that portion of the sock that protects the back of the leg from the protective material. In the event of an athletic injury involving a bone fracture or like injury, the protective portion of the sock can be cut away with a conventional scissors cutting through the non-protective material. If the whole protective sock has the protection weave design, the safety sock will need to be pulled down and off in the conventional manner or removed with surgical cutting shears.

These and other objects, advantages and novel features of the present invention will become more apparent from the following description when taken in connection with the accompanying drawings which show, for the purposes of illustration only, plural embodiments in accordance with the present invention, and wherein:

DETAILED DESCRIPTION OF THE DRAWINGS

Figure 1:
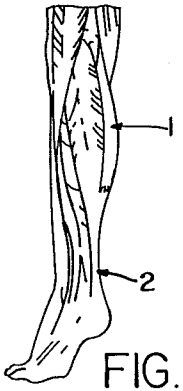
FIG. 1 is a diagram of the muscle structure of the leg showing the gastrocnemius tendon and muscle and the Achilles tendon.

Referring now to the drawings wherein like reference numerals are used to designate like parts and more particularly to FIG. 1 which shows an athlete's leg indicating the location of the gastrocnemius muscle 1 and achilles tendon 2. It is the object of the protective safety sock of this invention to protect this muscle and tendon from cuts.

Figure 2:
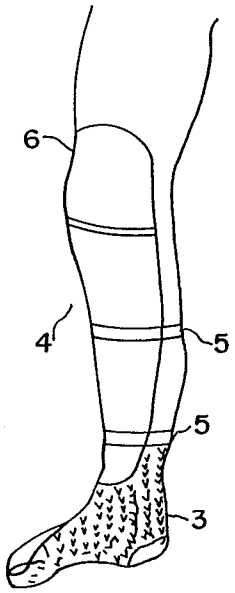
FIG. 2 is a schematic view of a hockey player's equipment worn under the protective safety sock of the instant invention.

FIG. 2 shows the normal undersock shin guard 4 and knee pad 6 worn by a hockey player, and includes straps 5 to secure the shin guard 4 around the hockey player's leg. The knee pad 6 is shown schematically as being hingedly attached to the shin guard 5. A normal athletic undersock 3 is provided to cushion the foot area.

Figure 3:
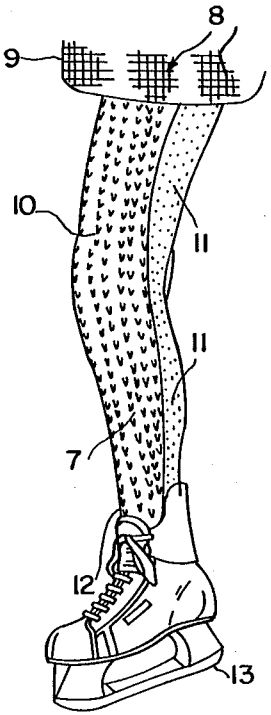
FIG. 3 shows a protective safety sock with protective material on its backside, pulled up over the foot, knee, and leg of a hockey player.

FIG. 3 shows one embodiment of the invention where a protective safety sock is provided over top of the particular equipment in FIG. 2. The protective sock extends from the foot to the buttocks area of the wearer. The front 10 of the sock is of conventional woven material, and the back portion 11 of the sock is made from an aramid fiber such as Nomex or Nomex III, and utilizes a metallic thread therein to additionally protect against cutting. The sock extends from the athlete's foot area, (encased by shoe 12 attached to a skate 13) upwardly above the knee to the thigh area 8 under pants 9, and its top is attached to garters (not shown) in a conventional manner.

Figure 4:
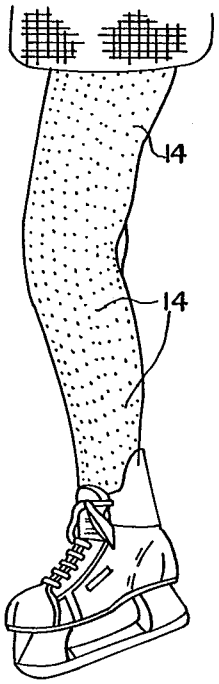
FIG. 4 shows a second embodiment of the protective safety sock where the sock is completely made from protective material.

FIG. 4 is similar to FIG. 3, but in this figure the whole sock 14 is made from Nomex or Nomex III and metal threads, and not just the rear portion thereof.

The protective material can utilize a weave of metallic and aramid fibers such as Nomex and Nomex III with KEVLAR. The particular method of manufacture of the sock utilizes standard sock making machinery and is of no import in this disclosure. What is important is that the protective material features of the sock are made available to the athlete in a flexible, lightweight, easily washable oversock.

While I have shown and described plural embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. Oversock means made from a woven flexible fabric comprising: aramid and metallic yarns, resistant to cutting by skate blades or other sharp edges, for protecting athletes' legs; and wherein said sock includes means to secure the same over the arch of a foot of an athlete and has sufficient length to extend upwardly above the athlete's knee and thigh to provide a soft and very flexible protective covering to inhibit cutting of at least the rear portion of the athlete's leg between the ankle and buttocks area while allowing for complete flexibility of leg motion.

2. An oversock according to claim 1, wherein the oversock material is constructed of aramid yarns containing nylon, polyester and metallic fibers.

3. An oversock according to claim 1, wherein only that portion of the oversock that covers the rear of the athlete's leg is made from said aramid and metallic yarns.

* * * * *